US010133214B2

(12) United States Patent
Mimura et al.

(10) Patent No.: US 10,133,214 B2
(45) Date of Patent: Nov. 20, 2018

(54) TONER CASE AND IMAGE FORMING APPARATUS

(71) Applicant: KYOCERA Document Solutions Inc., Osaka (JP)

(72) Inventors: Daisuke Mimura, Osaka (JP); Nobuhiro Fukuma, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/835,712

(22) Filed: Dec. 8, 2017

(65) Prior Publication Data

US 2018/0181026 A1 Jun. 28, 2018

(30) Foreign Application Priority Data

Dec. 22, 2016 (JP) ..... 2016-249284

(51) Int. Cl.
*G03G 15/08* (2006.01)
*G03G 21/16* (2006.01)
*G03G 21/18* (2006.01)

(52) U.S. Cl.
CPC ..... *G03G 15/0887* (2013.01); *G03G 15/0875* (2013.01); *G03G 15/0877* (2013.01);
(Continued)

(58) Field of Classification Search
CPC ..... G03G 15/0887; G03G 15/0875; G03G 15/0877; G03G 15/0886; G03G 21/1647; G03G 21/186
See application file for complete search history.

(56) References Cited

U.S. PATENT DOCUMENTS 6,418,292 B1 * 7/2002 Isobe ..... G03G 15/0855 399/258
9,436,126 B1 9/2016 Anderson, Jr. et al.
(Continued)

FOREIGN PATENT DOCUMENTS

EP 2530532 A1 12/2012
EP 3081991 A1 10/2016
JP 2001-305841 A 11/2001

OTHER PUBLICATIONS

Extended European Search Report issued by the European Patent Office dated May 18, 2018 which corresponds to EP17206078.2-1022 and is related to U.S. Appl. No. 15/835,712.
(Continued)

*Primary Examiner* — Rodney A Bonnette
(74) *Attorney, Agent, or Firm* — Studebaker & Brackett PC

(57) ABSTRACT

A toner case includes a case main body, a rotator, a transmitter, a moving mechanism and a shutter. The case main body has a discharge port. The rotator is stored in the case main body and rotates around a rotation axis. The transmitter is arranged outside the case main body. As the shutter moves along a rotation axis direction of the rotator from a closing position where the shutter closes the discharge port to an opening position where the shutter opens the discharge port, the moving mechanism moves the transmitter from a first position to a second position which is arranged at an outside of the first position in the rotation axis direction. As the shutter moves from the opening position to the closing position, the moving mechanism moves the transmitter from the second position to the first position.

12 Claims, 16 Drawing Sheets

(52) U.S. Cl.
CPC ..... *G03G 15/0886* (2013.01); *G03G 21/1647* (2013.01); *G03G 21/186* (2013.01)

(56) References Cited

U.S. PATENT DOCUMENTS

| | | | | |
|---|---|---|---|---|
| 10,073,375 | B2 * | 9/2018 | Mimura | G03G 15/0872 |
| 2005/0196184 | A1 | 9/2005 | Koyama et al. | |
| 2006/0269305 | A1 | 11/2006 | Murakami et al. | |
| 2010/0111574 | A1 | 5/2010 | Ichikawa | |
| 2012/0263504 | A1 | 10/2012 | Nagashima | |
| 2012/0328307 | A1 | 12/2012 | Oda et al. | |
| 2014/0044459 | A1 | 2/2014 | Hotani | |
| 2015/0139688 | A1 * | 5/2015 | Leemhuis | G03G 21/1604 399/110 |
| 2015/0277281 | A1 | 10/2015 | Mushika et al. | |
| 2015/0338825 | A1 | 11/2015 | Leemhuis et al. | |
| 2016/0154376 | A1 | 6/2016 | Xiao et al. | |
| 2018/0164715 | A1 * | 6/2018 | Mimura | G03G 15/0887 |
| 2018/0181027 | A1 * | 6/2018 | Mimura | G03G 21/1647 |
| 2018/0203382 | A1 * | 7/2018 | Mimura | G03G 15/0877 |

OTHER PUBLICATIONS

Extended European Search Report issued by the European Patent Office dated Mar. 27, 2018 which corresponds to EP17206088.1-1022 and is related to U.S. Appl. No. 15/835,712.

Extended European Search Report issued by the European Patent Office dated Apr. 20, 2018, which corresponds to EP17206076.6-1022 and is related to U.S. Appl. No. 15/835,712.

An Office Action issued by the Australian Patent Office dated Aug. 17, 2018 which corresponds to Australian Patent Application No. 2017272313 and is related to U.S. Appl. No. 15/835,712.

* cited by examiner

TONER CASE AND IMAGE FORMING APPARATUS

INCORPORATION BY REFERENCE

This application is based on and claims the benefit of priority from Japanese patent application No. 2016-249284 filed on Dec. 22, 2016, which is incorporated by reference in its entirety.

BACKGROUND

The present disclosure relates to a toner case and an image forming apparatus including the toner case.

An image forming apparatus, such as a printer, a copying machine, a facsimile and a multifunctional peripheral, includes a toner case which replenishes a developing device with a toner (a developer). For instance, the toner case includes a case main body storing the toner, a rotator stored in the case main body and rotating around a rotation axis and a transmitter arranged outside the case main body and transmitting rotation to the rotator. In such a toner case, by transmitting the rotation from the transmitter to the rotator, the toner in the case main body is agitated or conveyed by the rotator.

SUMMARY

In accordance with an aspect of the present disclosure, a toner case includes a case main body, a rotator, a transmitter, a moving mechanism and a shutter. The case main body has a discharge port through which a toner is discharged. The rotator is stored in the case main body and rotates around a rotation axis. The transmitter is arranged outside the case main body and transmits rotation to the rotator. The moving mechanism moves the transmitter between a first position and a second position which is arranged at an outside of the first position in a rotation axis direction of the rotator. The shutter moves along the rotation axis direction between a closing position where the shutter closes the discharge port and an opening position where the shutter opens the discharge port. As the shutter moves from the closing position to the opening position, the moving mechanism moves the transmitter from the first position to the second position. As the shutter moves from the opening position to the closing position, the moving mechanism moves the transmitter from the second position to the first position.

In accordance with an aspect of the present disclosure, an image forming apparatus includes the toner case and an attachment part to which the toner case is detachably attached.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, a multifunctional peripheral 1 (an example of an image forming apparatus) according to one embodiment of the present disclosure will be described. Arrows Fr, Rr, L, R, U and Lo shown in each figure respectively indicate a front side, a rear side, a left side, a right side, an upper side and a lower side of the multifunctional peripheral 1.

Firstly, an entire structure of the multifunctional peripheral 1 will be described.

Figure 1:
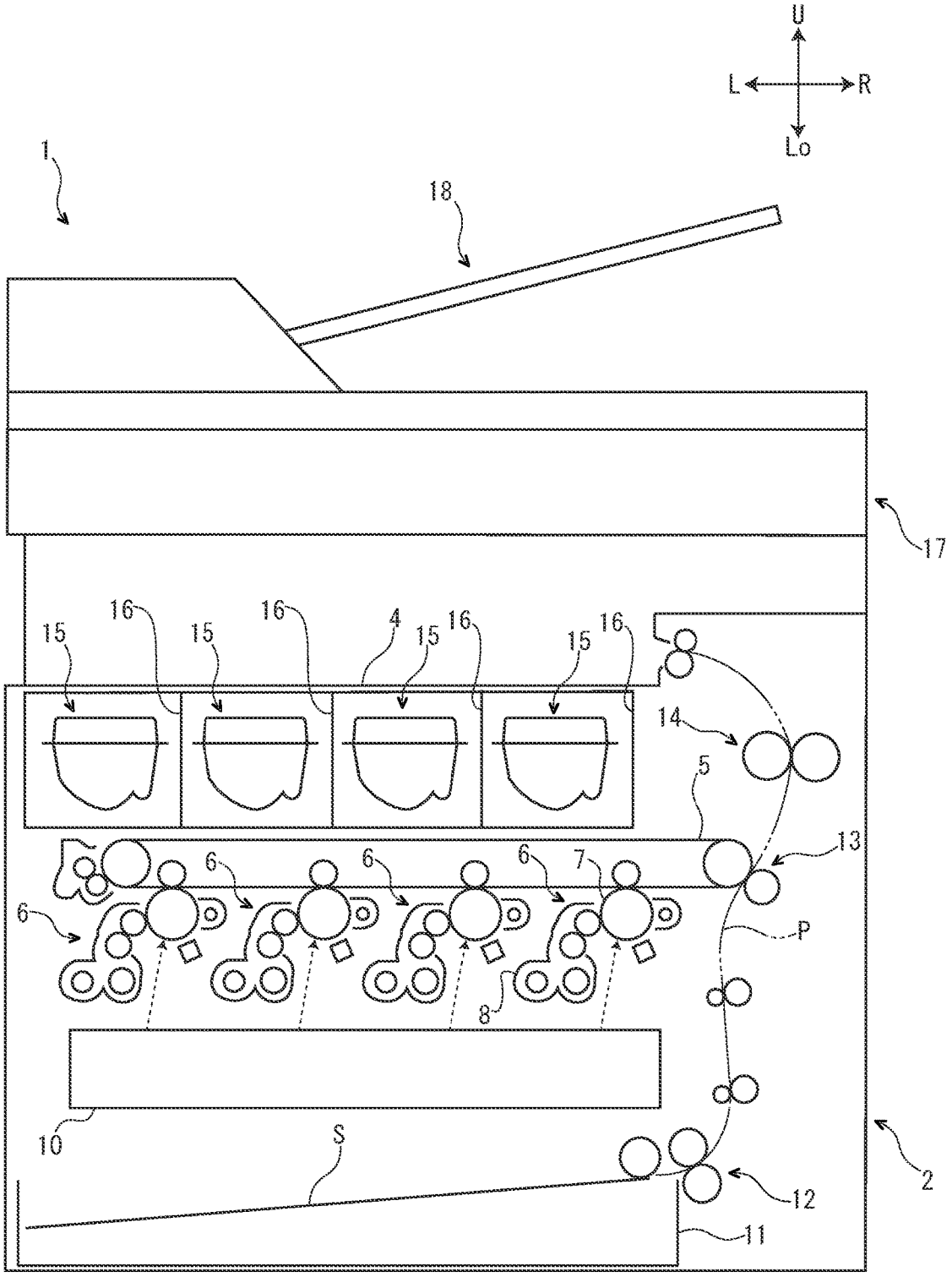
FIG. 1 is a schematic view showing a multifunctional peripheral according to one embodiment of the present disclosure.

With reference to FIG. 1, the multifunctional peripheral 1 includes a box-shaped multifunctional peripheral main body 2 (an example of an apparatus main body). In an upper portion of the multifunctional peripheral main body 2, an ejected sheet tray 4 is provided. In an approximate center portion of the multifunctional peripheral main body 2, an intermediate transferring belt 5 and four image forming parts 6 are stored. The four image forming parts 6 corresponds to four colors, for example, black, cyan, magenta and yellow, of a toner (a developer). Each image forming part 6 includes a photosensitive drum 7 (an example of an image carrier) and a developing device 8. In a lower portion of the multifunctional peripheral main body 2, an exposing device 10 is stored. In a lower end portion of the multifunctional peripheral main body 2, a sheet feeding cassette 11 storing a sheet S (an example of a recording medium) is stored.

In a right side portion of the multifunctional peripheral main body 2, a conveying path P for the sheet S is provided. At an upstream end of the conveying path P, a sheet feeding part 12 is provided. At a middle portion of the conveying path P, a secondary transferring part 13 is provided. At a downstream portion of the conveying path P, a fixing device 14 is provided.

In the upper portion of the multifunctional peripheral main body 2, four toner containers 15 (an example of a toner case) are stored below the ejected sheet tray 4. The toner containers 15 corresponds to the four colors, for example, black, cyan, magenta and yellow, of the toner (the developer). The four toner containers 15 are detachably attached to four attachment parts 16 provided in the upper portion of the multifunctional peripheral main body 2.

At an upper end portion of the multifunctional peripheral main body 2, an image reading device 17 configured to read an image of a document is provided. Above the image reading device 17, a document conveying device 18 configured to convey the document automatically to an image reading position of the image reading device 17 is provided.

Next, an operation of the multifunctional peripheral 1 will be described.

Firstly, light (refer to a dotted line in FIG. 1) emitted from the exposing device 10 exposes the photosensitive drum 7 of each image forming part 6 to form an electrostatic latent image on the photosensitive drum 7. The electrostatic latent image is developed by the developing device 8 of each image forming part 6. Thereby, a toner image is carried on the photosensitive drum 7. The toner image is primarily transferred from the photosensitive drum 7 of each image forming part 6 to the intermediate transferring belt 5. Thereby, a full color toner image is formed on the intermediate transferring belt 5.

On the other hand, the sheet S fed from the sheet feeding cassette 11 by the sheet feeding part 12 is conveyed to a downstream side along the conveying path P and enters the secondary transferring part 13. At the secondary transferring part 13, the full color toner image formed on the intermediate transferring belt 5 is secondarily transferred to the sheet S. The sheet S on which the toner image is secondarily transferred is further conveyed to the downstream side along the conveying path P and enters the fixing device 14. The fixing device 14 fixes the toner image on the sheet S. The sheet S on which the toner image is fixed is ejected on the ejected sheet tray 4.

Next, the four toner containers 15 will be described in detail. The four toner containers 15 have the same configuration, and, therefore, one of the toner containers 15 will be described and other toner containers will not be described.

Figure 2:
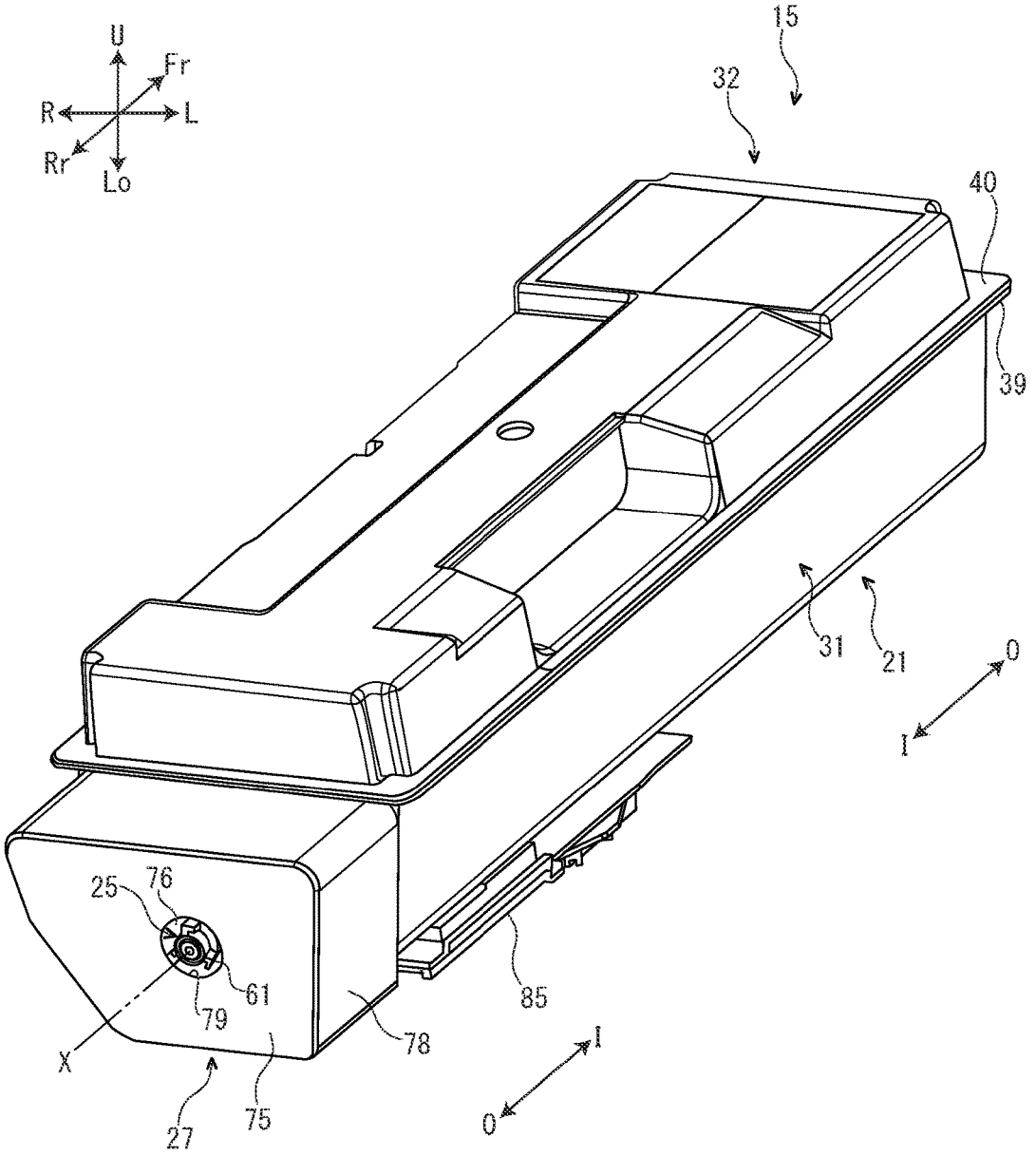
FIG. 2 is a perspective view showing a toner container according to the one embodiment of the present disclosure.

An arrow O shown in each figure after FIG. 2 indicates an outside in the front-and-rear direction of the toner container 15, and an arrow I shown in each figure after FIG. 2 indicates an inside in the front-and-rear direction of the toner container 15.

Figure 3:
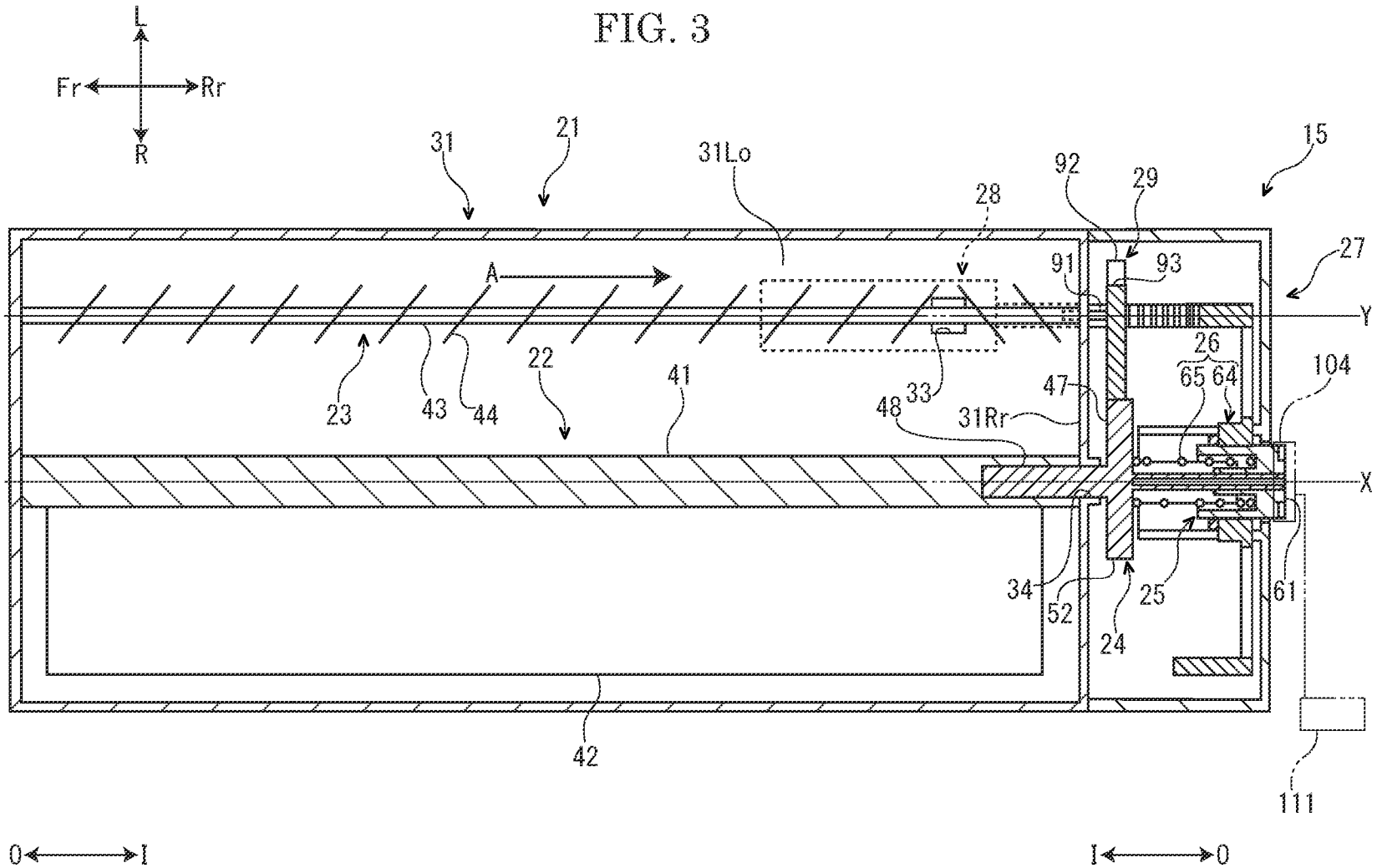
FIG. 3 is a sectional view schematically showing the toner container according to the one embodiment of the present disclosure.

With reference to FIG. 2 and FIG. 3, the toner container 15 includes a case main body 21, an agitator 22 (an example of a rotator) stored in a center portion of the case main body 21, a conveyer 23 (an example of a rotator) stored in a left lower portion of the case main body 21, a supporter 24 arranged at a rear end side of the case main body 21, a transmitter 25 and a moving mechanism 26 which are arranged at a rear side (the outside in the front-and-rear direction) of the supporter 24, a cover 27 covering a rear side (the outside in the front-and-rear direction) of the case main body 21, a shutter 28 arranged at a left lower side of a rear side portion of the case main body 21 and a connector 29 arranged at a left lower side of the supporter 24.

The case main body 21 has a shape elongated in the front-and-rear direction. The case main body 21 stores the toner (the developer). The case main body 21 includes a storage 31 and a lid 32 provided at an upper side of the storage 31.

Figure 4:
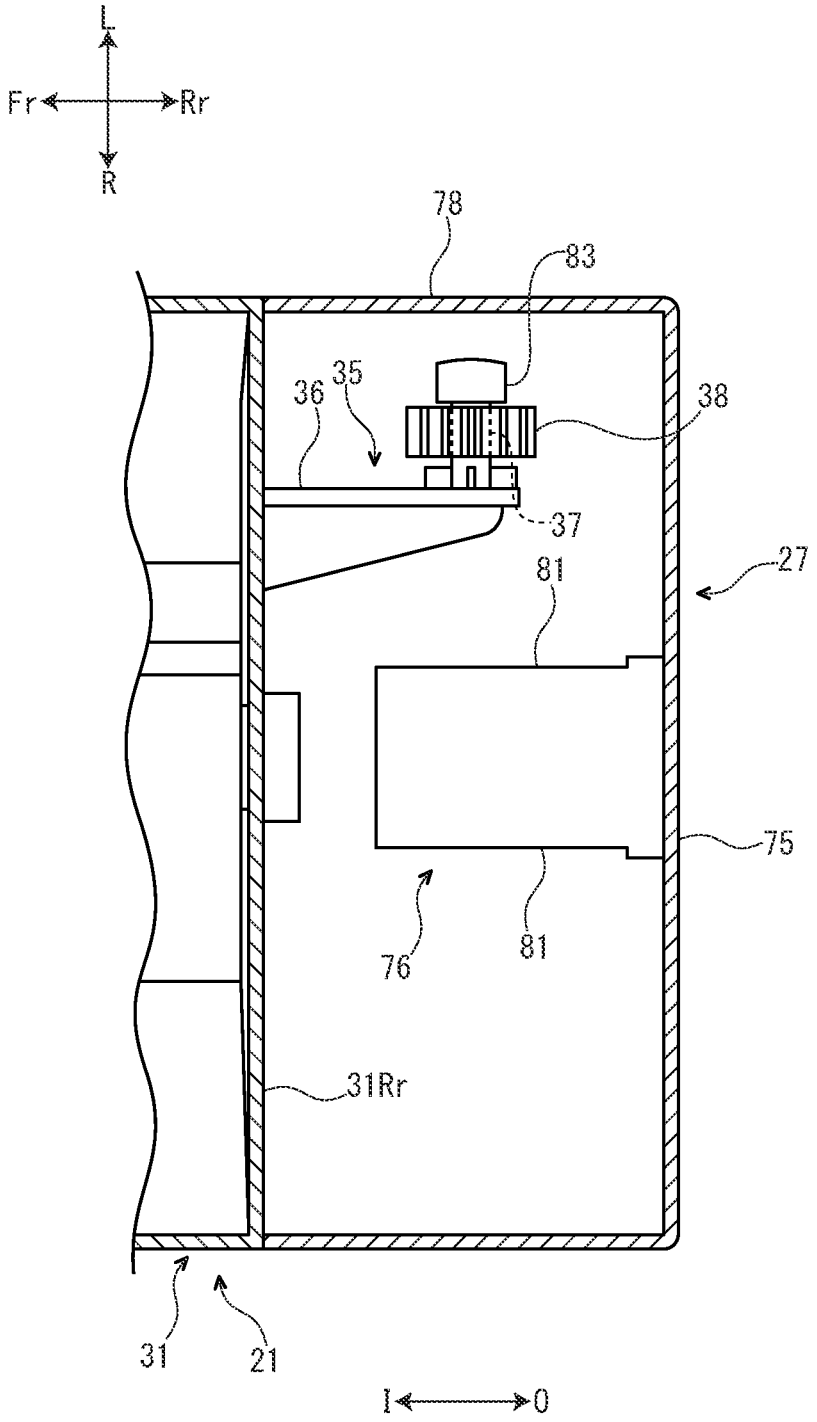
FIG. 4 is a sectional view showing a case main body, a cover and a pinion gear, in the toner container according to the one embodiment of the present disclosure.

The storage 31 of the case main body 21 is formed in a box-like shape whose upper side is opened. In a left rear portion of a bottom wall 31Lo of the storage 31, a discharge port 33 through which the toner is discharged is provided. In a center portion of a rear side wall 31Rr of the storage 31, a supporting hole 34 is provided. Around an upper end of an outer circumference of the storage 31, a lower side flange portion 39 is provided. With reference to FIG. 4, on a left side portion of a rear face (a face at the outside in the front-and-rear direction) of the rear side wall 31Rr, a supporting piece 35 is protruded. The supporting piece 35 includes a main plate 36 extending from the rear face of the rear side wall 31Rr of the storage 31 to the rear side and a shaft 37 extending from a rear portion of the main plate 36 to the left side. A pinion gear 38 is rotatably supported by the shaft 37. The pinion gear 38 is arranged at a rear side (the outside in the front-and-rear direction) of the storage 31 of the case main body 21 and outside the case main body 21.

With reference to FIG. 2, the lid 32 of the case main body 21 is formed in a box-like shape whose lower side is opened. Around a lower end of an outer circumference of the lid 32, an upper side flange portion 40 is provided. The upper side flange portion 40 is fixed to the lower side flange portion 39 of the storage 31. Thereby, the lid 32 is integrated with the storage 31. An inner space of the lid 32 is communicated with an inner space of the storage 31.

With reference to FIG. 3, the agitator 22 of the toner container 15 is stored in the storage 31 of the case main body 21. The agitator 22 is rotatable around a first rotation axis X extending along the front-and-rear direction. That is, the front-and-rear direction is a rotation axis direction of the agitator 22 in the present embodiment. The agitator 22 includes an agitating shaft 41 extending along the front-and-rear direction and an agitating blade 42 mounted to the agitating shaft 41. The agitating blade 42 is made of resin film, for example, and formed in a sheet-like shape.

The conveyer 23 of the toner container 15 is stored in the storage 31 of the case main body 21. The conveyer 23 is rotatable around a second rotation axis Y extending along the front-and-rear direction. That is, the front-and-rear direction is a rotation axis direction of the conveyer 23. The conveyer 23 includes a conveying shaft 43 extending along the front-and-rear direction and a spiral conveying fin 44 protruding on an outer circumference of the conveying shaft 43.

Figure 5:
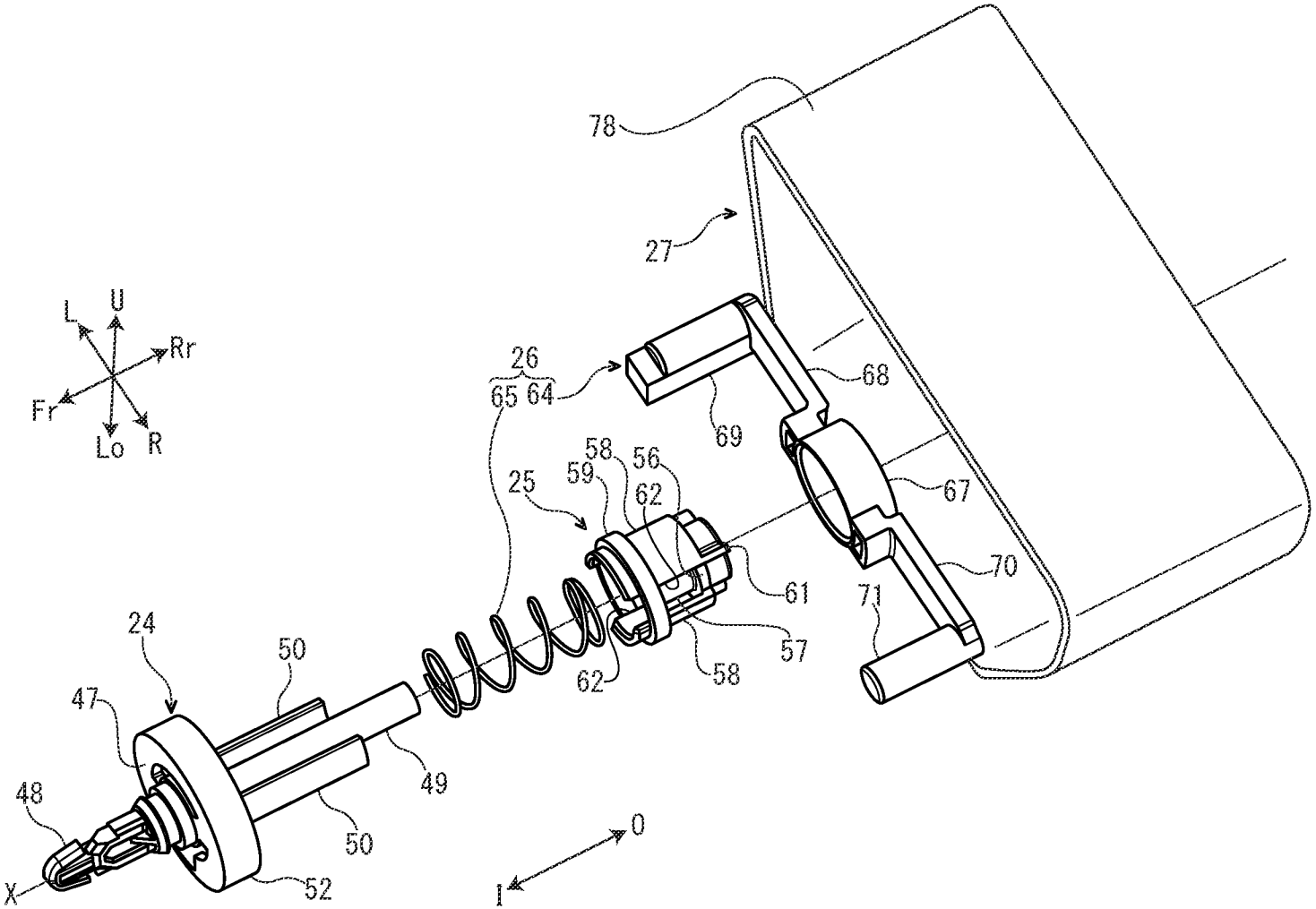
FIG. 5 is a disassembled perspective view showing a supporter, a transmitter, a moving mechanism and the cover, in the toner container according to the one embodiment of the present disclosure.

With reference to FIG. 5, the supporter 24 of the toner container 15 includes an annular exposed piece 47, a coupling piece 48 protruding from a center portion of the exposed piece 47 to the front side (the inside in the front-and-rear direction), a boss piece 49 protruding from the center portion of the exposed piece 47 to the rear side (the outside in the front-and-rear direction) and a pair of inserted pieces 50 protruding from the exposed piece 47 at an outer circumference of the boss piece 49 to the rear side (the outside in the front-and-rear direction).

With reference to FIG. 3, the exposed piece 47 of the supporter 24 is arranged at the rear side (the outside in the front-and-rear direction) of the storage 31 of the case main body 21, and exposed to the outside of the case main body 21. Around an outer circumferential face of the exposed piece 47, a driving gear 52 is provided.

The coupling piece 48 of the supporter 24 penetrates through the supporting hole 34 provided in the rear side wall 31Rr of the storage 31 of the case main body 21. Thereby, the supporter 24 is rotatably supported by the case main body 21. A tip end portion of the coupling piece 48 is inserted into an inside of the storage 31, and fixed to a rear end portion of the agitating shaft 41 of the agitator 22. Thereby, the supporter 24 is connected to the agitator 22, and rotatable together with the agitator 22 around the first rotation axis X.

With reference to FIG. 6 to FIG. 9, the transmitter 25 of the toner container 15 is arranged at the rear side (the outside in the front-and-rear direction) of the storage 31 of the case main body 21 and outside the case main body 21. The transmitter 25 moves linearly along the front-and-rear direction between a first position (refer to FIG. 6 and FIG. 7) and a second position (refer to FIG. 8 and FIG. 9) which is arranged at the rear side (the outside in the front-and-rear direction) of the first position.

With reference to FIG. 5, the transmitter 25 includes a transmitting piece 56, a cylindrical piece 57 protruding from a center portion of the transmitting piece 56 to the front side (the inside in the front-and-rear direction), a pair of protruding pieces 58 protruding from the transmitting piece 56 at an outer circumference of the cylindrical piece 57 to the front side (the inside in the front-and-rear direction) and an approximate annular fixing piece 59 fixed to outer circumferential faces of front portions of the pair of protruding pieces 58. On a rear face (a face at the outside in the front-and-rear direction) of the transmitting piece 56, a transmitting coupling 61 is provided. Into the cylindrical piece 57, the boss piece 49 of the supporter 24 is inserted. A pair of inserting grooves 62 is formed between the pair of protruding pieces 58. Into each inserting groove 62, each inserted piece 50 of the supporter 24 is inserted. According to the configuration described above, the transmitter 25 is supported by the supporter 24 in a state where the transmitter 25 is movable along the front-and-rear direction and is not rotatable with respect to the supporter 24.

The moving mechanism 26 of the toner container 15 includes a holder 64 and a coil spring 65 (an example of a pressing member). In the following description regarding the holder 64, "an outside in a radial direction" indicates a side separating from the first rotation axis X, and "an inside in a radial direction" indicates a side approaching to the first rotation axis X.

With reference to FIG. 6 to FIG. 9, the holder 64 of the moving mechanism 26 moves along the front-and-rear direction between a first holding position (refer to FIG. 6 and FIG. 7) where the holder 64 holds the transmitter 25 in the first position and a second holding position (refer to FIG. 8 and FIG. 9) where the holder 64 holds the transmitter 25 in the second position.

With reference to FIG. 5, the holder 64 includes a base part 67, a left arm part 68 extending linearly from an outer circumferential face of the base part 67 to the left side (the outside in the radial direction), a first rack piece 69 extending linearly from an end portion of the left arm part 68 at the outside in the radial direction to the front side (the inside in the front-and-rear direction), a right arm part 70 extending linearly from the outer circumferential face of the base part 67 to the right side (the outside in the radial direction) and a boss part 71 extending linearly from an end portion of the right arm part 70 at the outside in the radial direction to the front side (the inside in the front-and-rear direction).

The base part 67 of the holder 64 is formed in a cylindrical shape with the first rotation axis X as an axis center. Into an inner circumference of the base part 67, the pair of protruding pieces 58 of the transmitter 25 is rotatably inserted. Thereby, the base part 67 holds the transmitter 25 rotatably. A front edge portion (an edge portion at the inside in the front-and-rear direction) of the base part 67 comes into contact with the fixing piece 59 of the transmitter 25.

With reference to FIG. 6 to FIG. 9, on a lower face of the first rack piece 69 of the holder 64, a first rack gear 72 is provided. The first rack gear 72 is meshed with the pinion gear 38 from the upper side.

With reference to FIG. 5, the coil spring 65 of the moving mechanism 26 is interposed between the supporter 24 and the transmitter 25. The coil spring 65 is attached to an outer circumference of the cylindrical piece 57 of the transmitter 25. The coil spring 65 presses the transmitter 25 to the rear side (the outside in the front-and-rear direction) to press the transmitter 25 against the holder 64.

With reference to FIG. 2, the cover 27 of the toner container 15 includes a plate-shaped main wall 75, a guide wall 76 arranged at a center side of the main wall 75 and a circumferential wall 78 arranged at an outer circumference side of the main wall 75.

The main wall 75 of the cover 27 is provided along a plane crossing the first rotation axis X. In a center portion of the main wall 75, a circular through hole 79 is provided.

Figure 7:
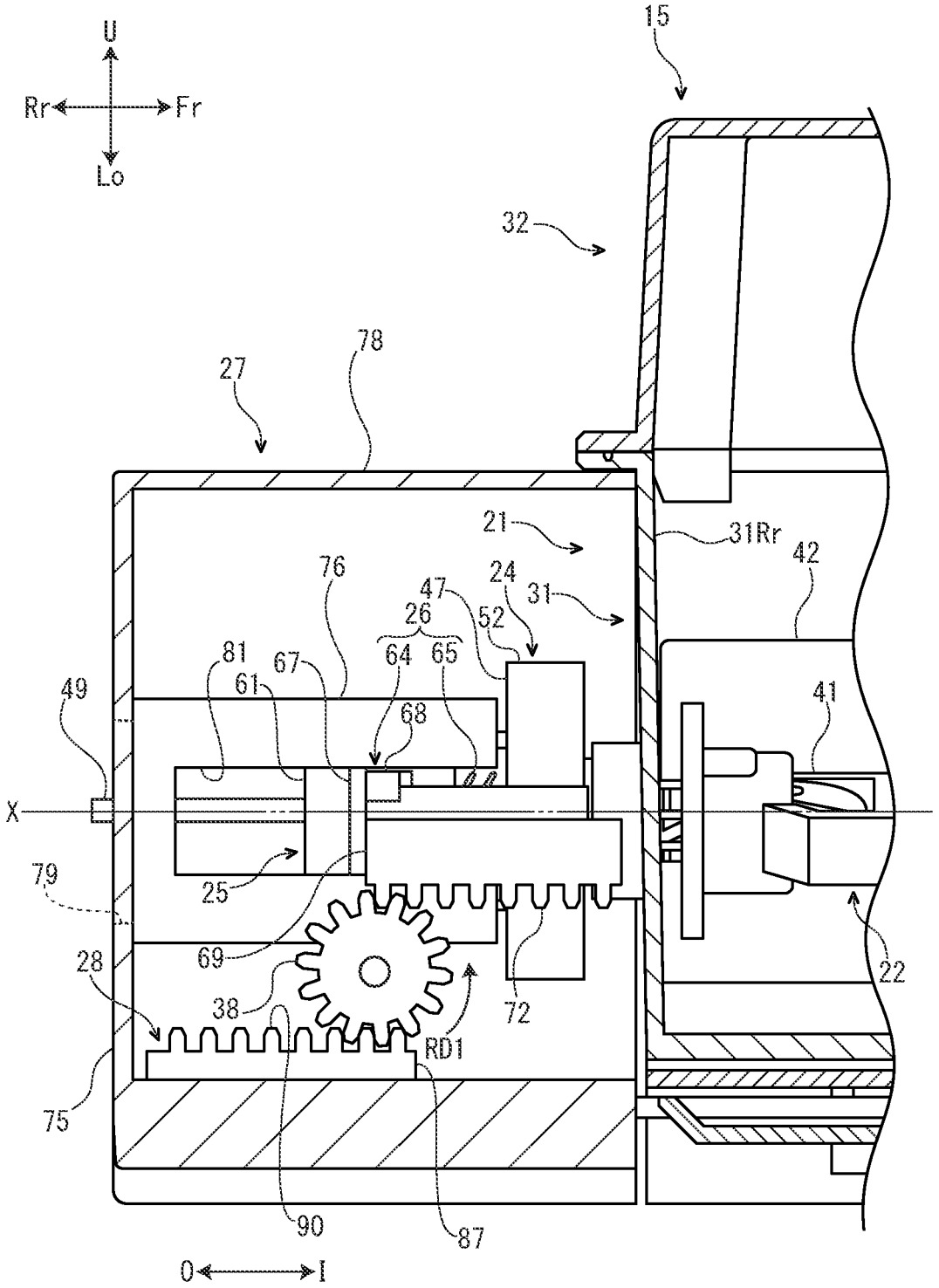
FIG. 7 is a sectional view showing the state where the transmitter is in the first position and the holder is in the first holding position, in the toner container according to the one embodiment of the present disclosure.
Figure 8:
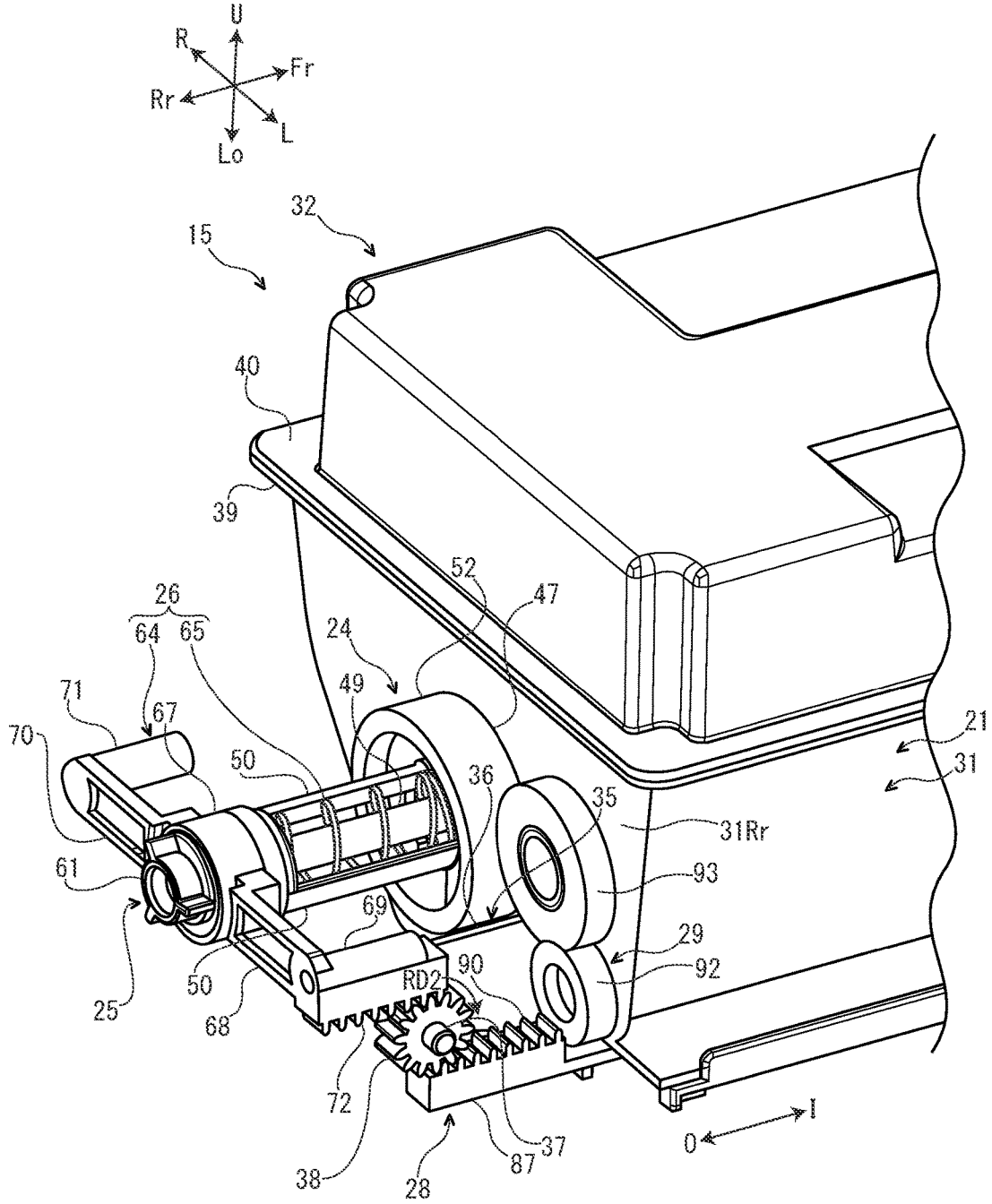
FIG. 8 is a perspective view showing a state where the transmitter is in a second position and the holder is in a second holding position, in the toner container according to the one embodiment of the present disclosure.
Figure 9:
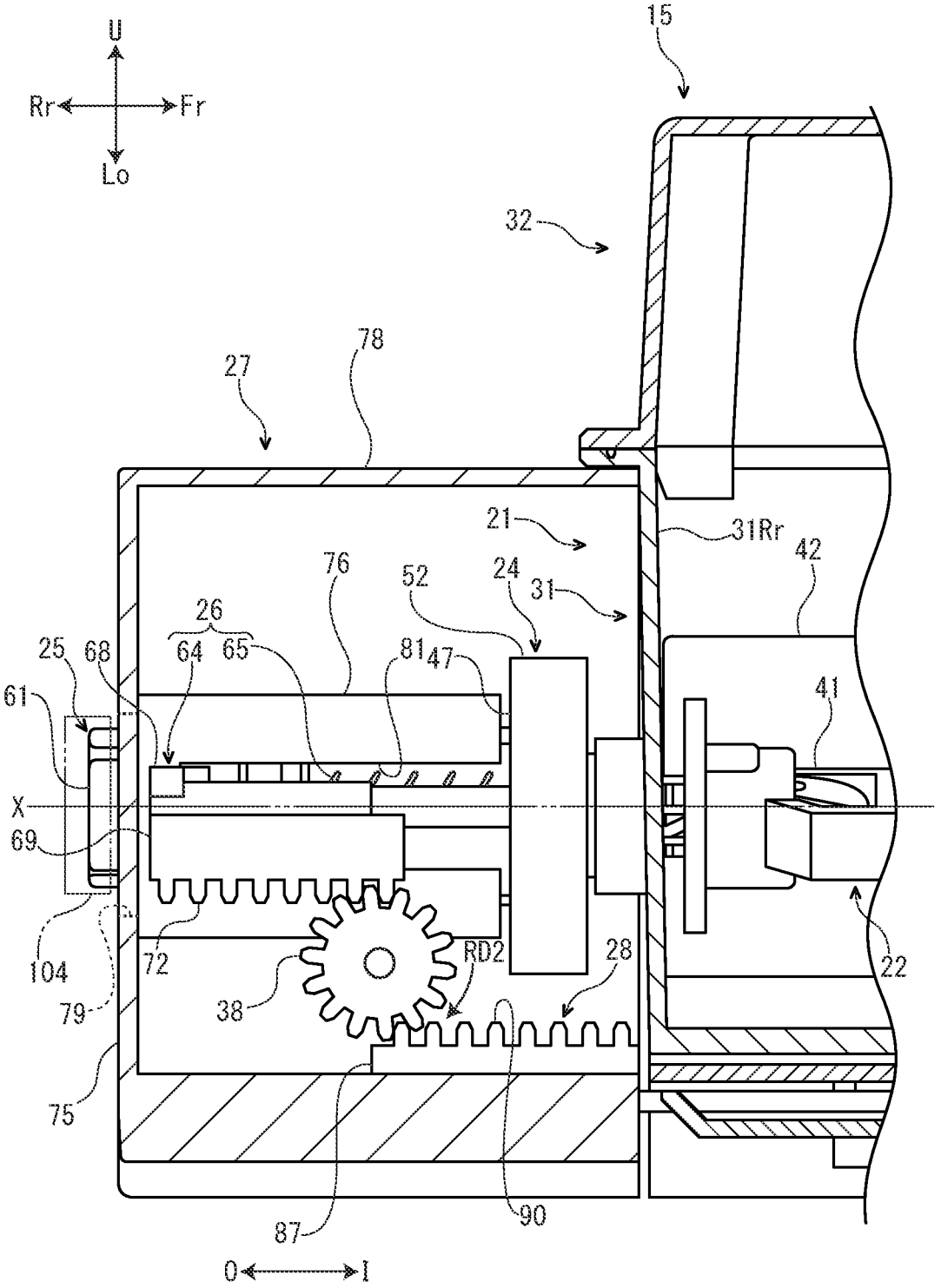
FIG. 9 is a sectional view showing the state where the transmitter is in the second position and the holder is in the second holding position, in the toner container according to the one embodiment of the present disclosure.

With reference to FIG. 7 and FIG. 9, the guide wall 76 of the cover 27 is formed in an approximate cylindrical shape with the first rotation axis X as an axis center. The guide wall 76 is protruded from the main wall 75 at an outer circumference of the through hole 79 to the front side (the inside in the front-and-rear direction). Into the guide wall 76, the base part 67 of the holder 64 is inserted. Thereby, the cover 27 supports the holder 64 movably along the front-and-rear direction. The guide wall 76 has a pair of left and right slits 81 (only the left slit 81 is shown in FIG. 7 and FIG. 9). Through the left slit 81, the left arm part 68 of the holder 64 is penetrated. Through the right slit 81, the right arm part 70 (refer to FIG. 5) of the holder 64 is penetrated.

With reference to FIG. 4, the circumferential wall 78 of the cover 27 is protruded from an outer circumference of the main wall 75 to the front side (the inside in the front-and-rear direction). On an inner face of a left side portion of the circumferential wall 78, a fitting piece 83 is protruded. Into the fitting piece 83, a tip end portion of the shaft 37 of the supporting piece 35 is fitted.

Figure 10:
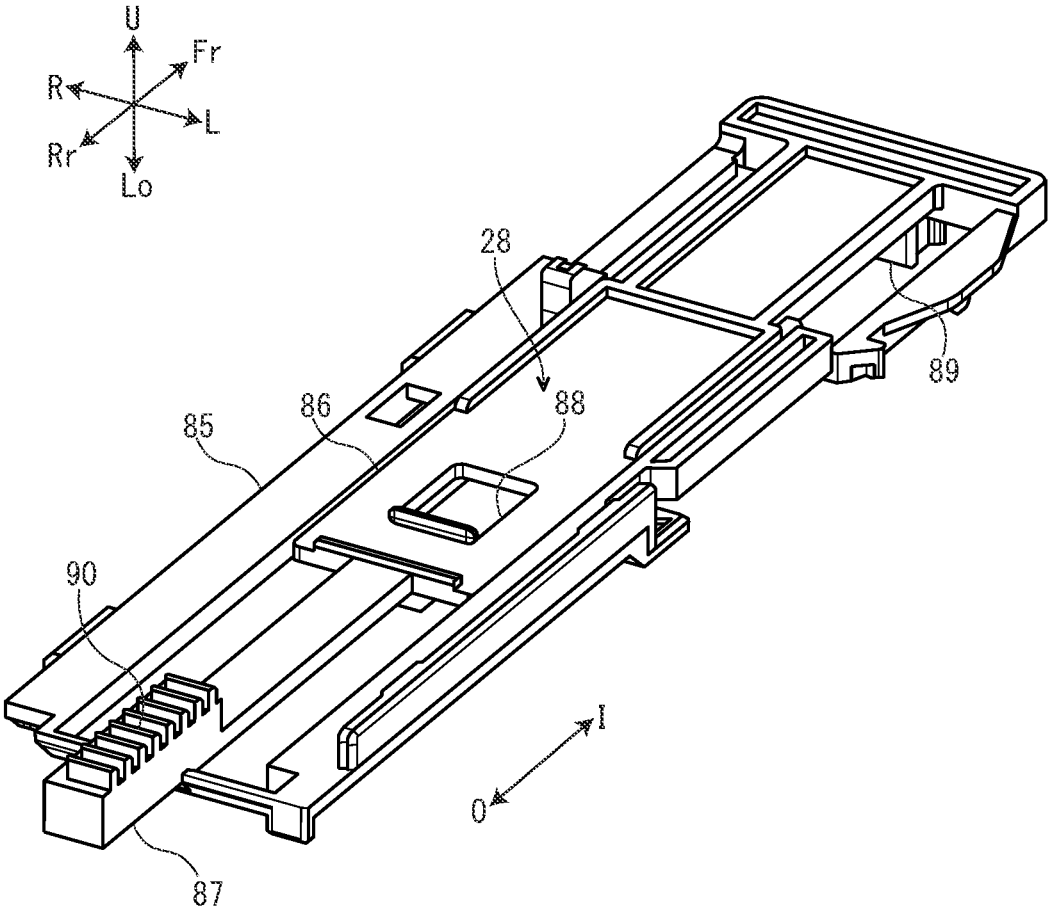
FIG. 10 is a perspective view showing a shutter and a supporting body, in the toner container according to the one embodiment of the present disclosure.

With reference to FIG. 10, the shutter 28 of the toner container 15 includes a shutter main body 86 and a second rack piece 87 extending from a rear end portion of the shutter main body 86 to the rear side (the outside in the front-and-rear direction).

Figure 11:
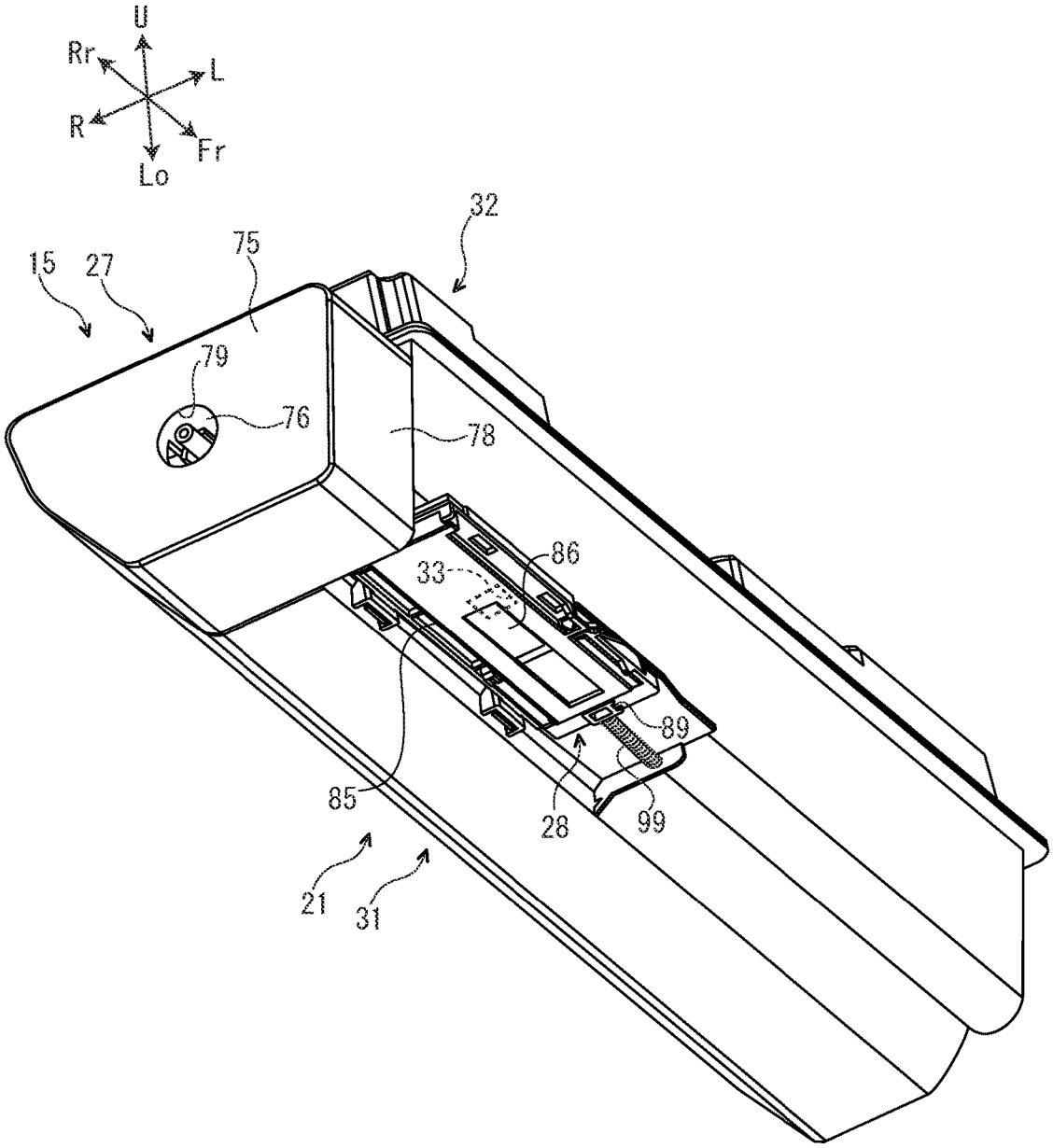
FIG. 11 is a perspective view showing a state where the shutter is in a closing position, in the toner container according to the one embodiment of the present disclosure.
Figure 12:
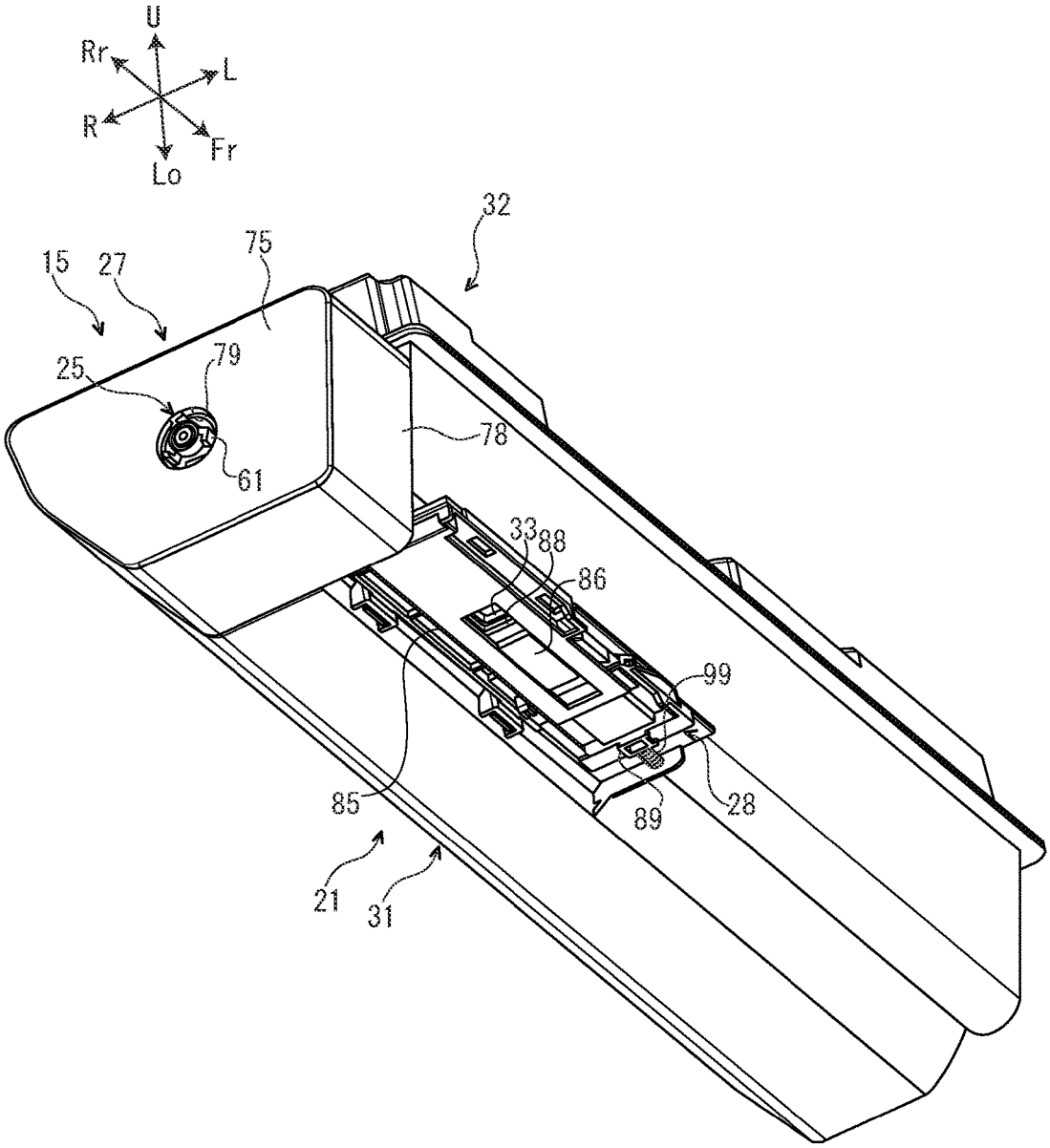
FIG. 12 is a perspective view showing a state where the shutter is in an opening position, in the toner container according to the one embodiment of the present disclosure.

The shutter main body 86 of the shutter 28 has a shape elongated in the front-and-rear direction. With reference to FIG. 11 and FIG. 12, the shutter main body 86 is arranged along a lower face (an outer face) of the storage 31 of the case main body 21. The shutter main body 86 is supported by a supporting body 85 fixed on the lower face of the case main body 21 from the lower side (the outer side). The shutter 28 moves along the front-and-rear direction between a closing position (refer to FIG. 11) where the shutter main body 86 closes the discharge port 33 of the storage 31 of the case main body 21 and an opening position (refer to FIG. 12) where the shutter main body 86 opens the discharge port 33. The shutter 28 is always biased to the closing position (refer to FIG. 11) by a biasing member 99, such as a coil spring.

With reference to FIG. 10, in a rear portion of the shutter main body 86 of the shutter 28, a communication port 88 is provided. The communication port 88 is arranged such that the communication port 88 is not communicated with the discharge port 33 of the storage 31 of the case main body 21 in a state where the shutter 28 is in the closing position (refer to FIG. 11) and is communicated with the discharge port 33 in a state where the shutter 28 is in the opening position (refer to FIG. 12). On a front end portion of a lower face (an outer face) of the shutter main body 86, a protrusion 89 is provided.

With reference to FIG. 10, the second rack piece 87 of the shutter 28 has a shape elongated in the front-and-rear direction. With reference to FIG. 6 to FIG. 9, a rear portion of the second rack piece 87 is arranged at the rear side (the outside in the front-and-rear direction) of the storage 31 of the case main body 21. On an upper face of the rear portion of the second rack piece 87, a second rack gear 90 is provided. The second rack gear 90 is meshed with the pinion gear 38 from the lower side.

With reference to FIG. 3, the connector 29 of the toner container 15 includes a connecting shaft 91 and a connecting gear 92 provided around an outer circumference of the connecting shaft 91. The connecting shaft 91 is penetrated through the rear side wall 31Rr of the storage 31 of the case main body 21, and fixed to a rear end portion of the conveying shaft 43 of the conveyer 23. The connecting gear 92 is arranged at the rear side (the outside in the front-and-rear direction) of the storage 31 of the case main body 21. The connecting gear 92 is connected to the driving gear 52 of the exposed piece 47 of the supporter 24 via an idle gear 93. According to the above described configuration, the supporter 24 is connected to the conveyer 23 via the idle gear 93 and the connector 29.

Next, the four attachment parts 16 will be described in detail. The four attachment parts 16 have the same configuration and, therefore, one of the attachment part 16 will be described and other attachment parts 16 will not be described.

Figure 13:
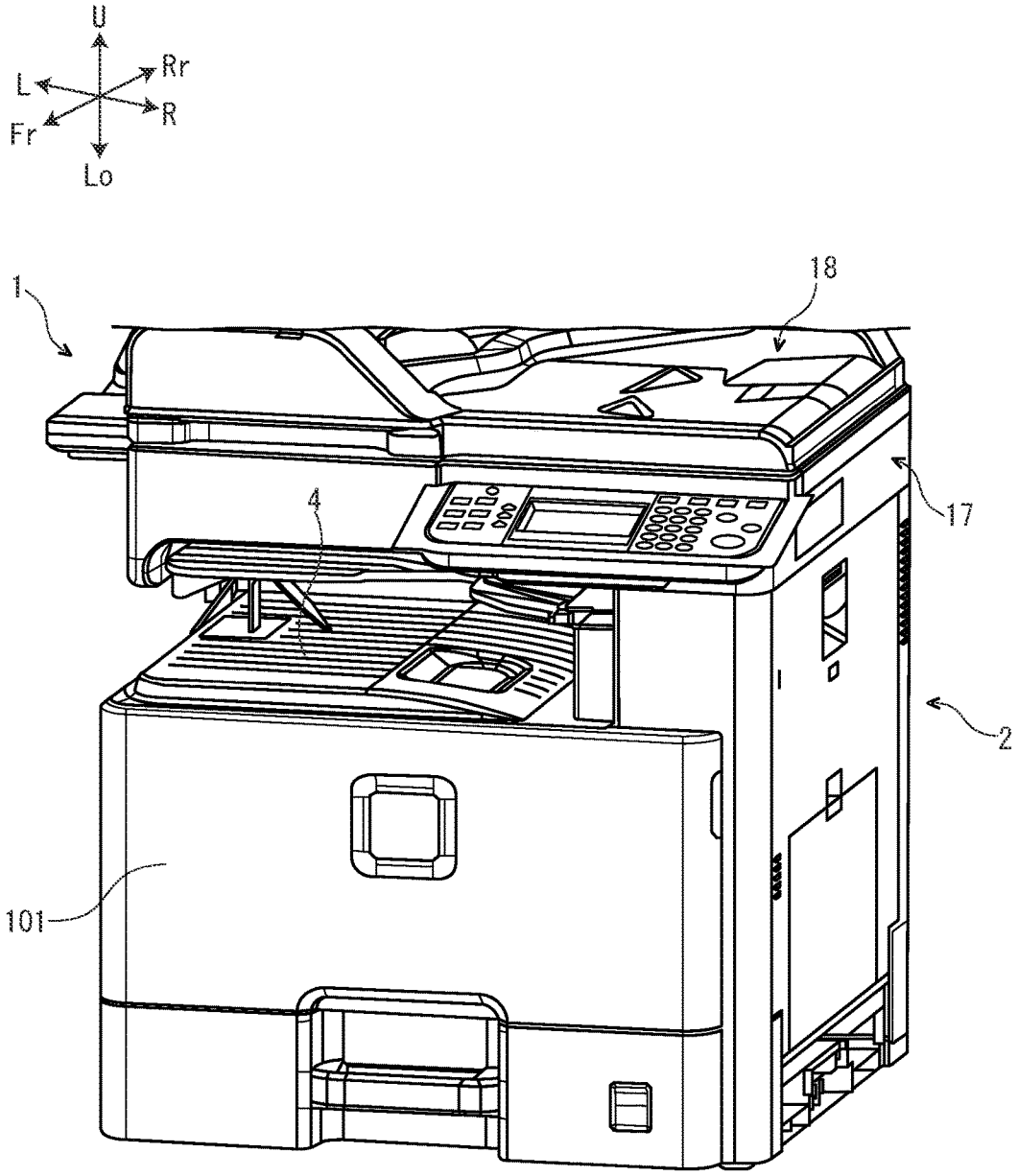
FIG. 13 is a perspective view showing a state where a front cover is closed, in the multifunctional peripheral according to the one embodiment of the present disclosure.
Figure 14:
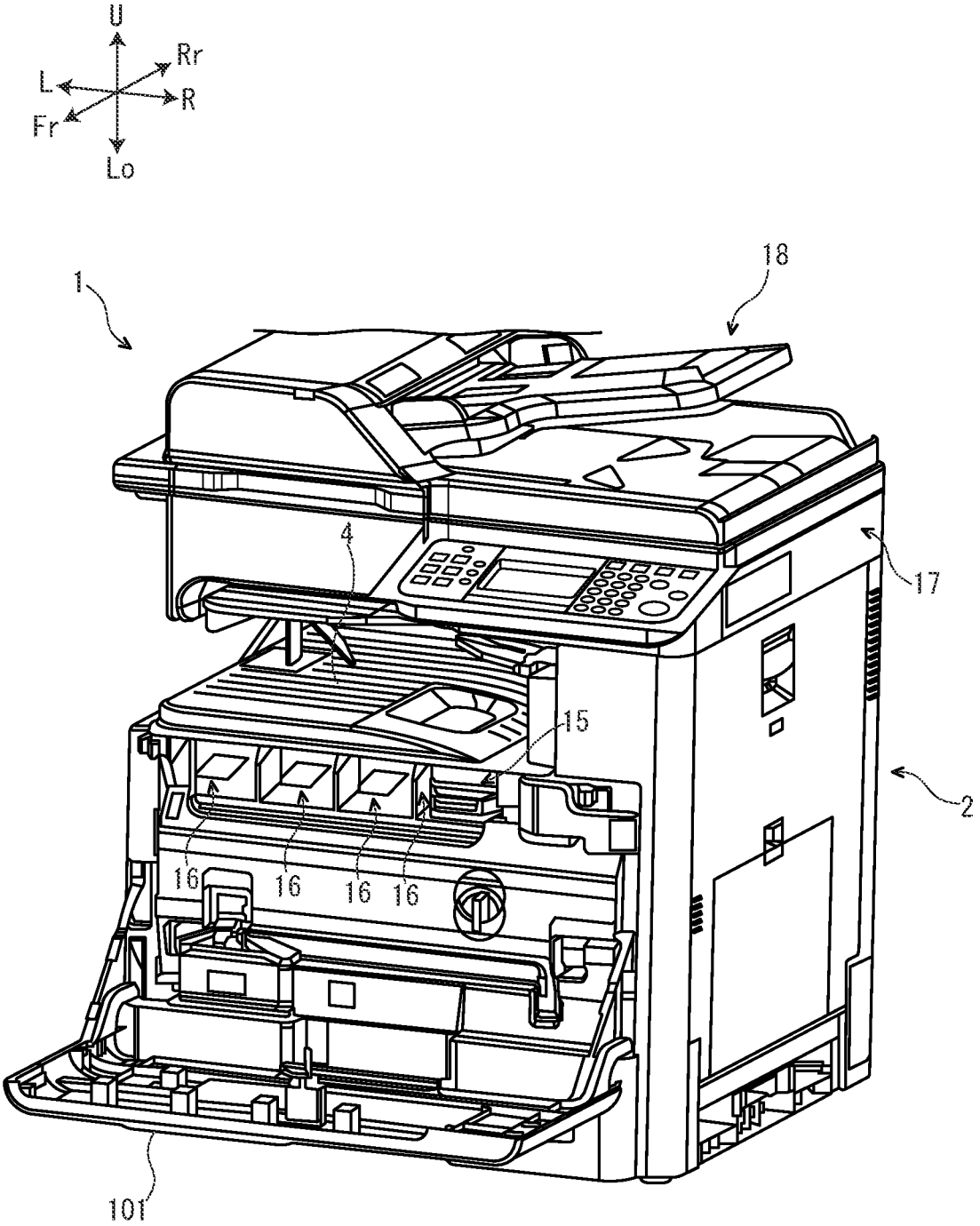
FIG. 14 is a perspective view showing a state where the front cover is opened, in the multifunctional peripheral according to the one embodiment of the present disclosure.
Figure 15:
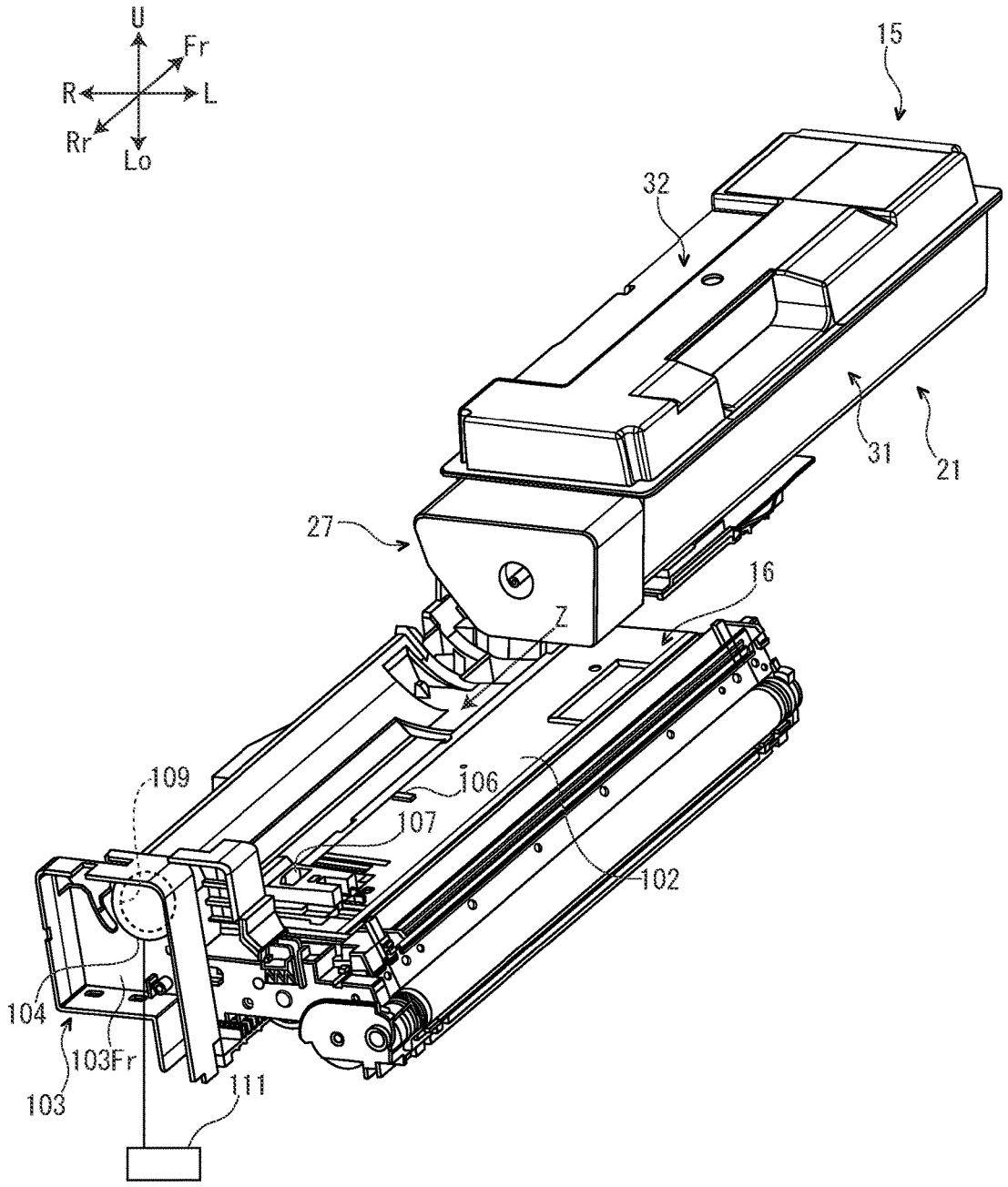
FIG. 15 is a perspective view showing a state before the toner container is attached to an attachment part, in the multifunctional peripheral according to the one embodiment of the present disclosure.
Figure 16:
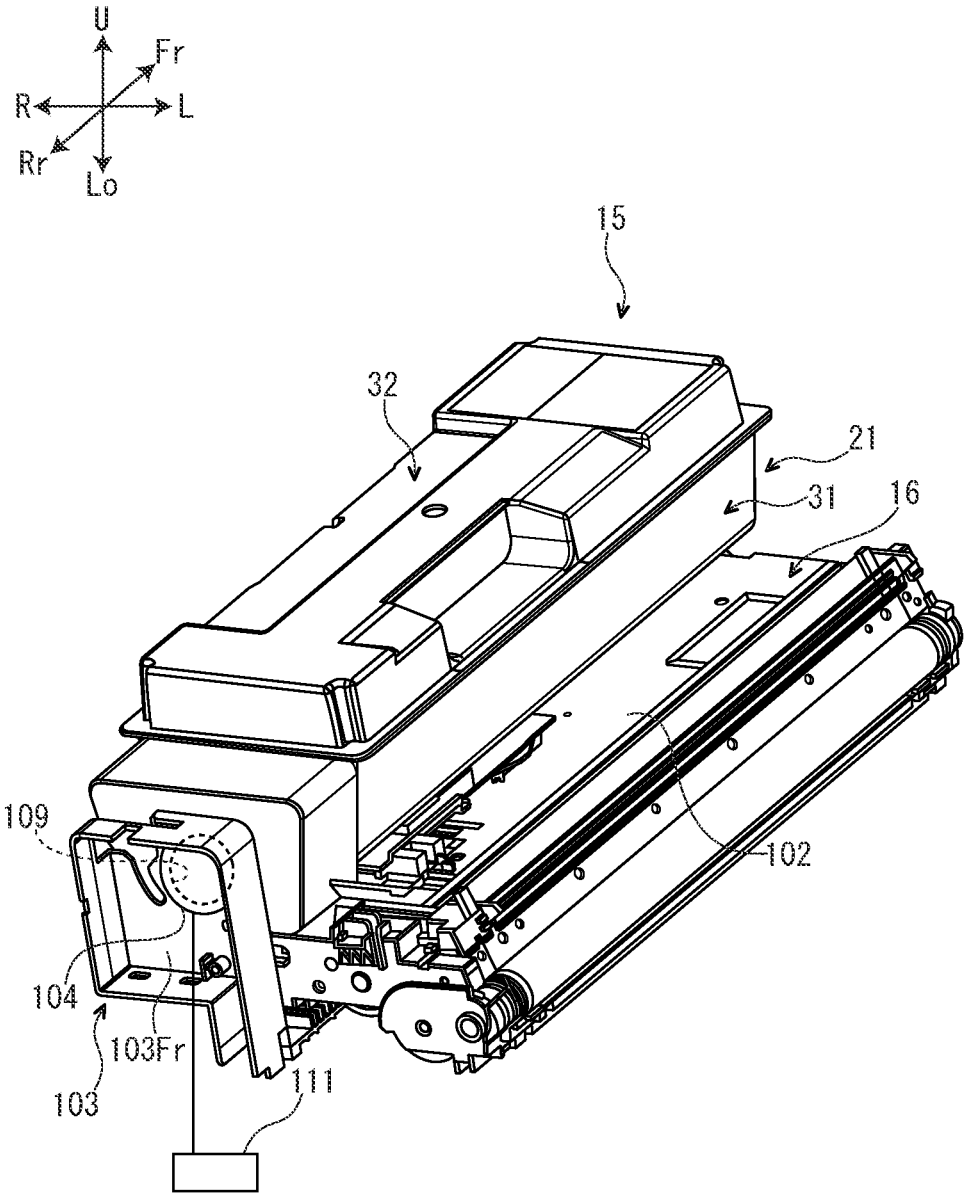
FIG. 16 is a perspective view showing a state where the toner container is attached to the attachment part, in the multifunctional peripheral according to the one embodiment of the present disclosure.

With reference to FIG. 13 and FIG. 14, a front side of the attachment part 16 is covered with an openable and closable front cover 101. By opening the front cover 101, it becomes possible to attach and detach the toner container 15 to and from the attachment part 16. With reference to FIG. 15 and FIG. 16, to the attachment part 16, the toner container 15 is detachably attached along an attachment direction Z from the front side to the rear side. The attachment direction Z is parallel with the front-and-rear direction.

The attachment part 16 includes a guide plate 102 extending along the front-and-rear direction, a casing 103 arranged at a rear side of the guide plate 102 and a driving coupling 104 stored in an upper portion of the casing 103. On an approximate center portion in the front-and-rear direction of an upper face of the guide plate 102, a restriction projection 106 (an example of a restriction part) is provided. In a rear portion of the guide plate 102, a replenishment port 107 is provided at a rear side of the restriction projection 106. In a front wall 103Fr of the casing 103, a circular hole 109 is provided. Through the hole 109, apart of the driving coupling 104 is exposed to an outside of the casing 103. The driving coupling 104 is connected to a driving source 111 constituted by a motor and the others.

Next, operation to discharge the toner from the toner container 15 will be described.

With reference to FIG. 3, when the toner is discharged from the toner container 15, in a state where the transmitting coupling 61 of the transmitter 25 is coupled to the driving coupling 104 and the discharge port 33 of the storage 31 is opened, the driving source 111 is driven. When the driving source 111 is driven, the driving coupling 104 is rotated by rotation driving force from the driving source 111. When the driving coupling 104 is thus rotated, rotation of the driving coupling 104 is transmitted to the agitator 22 by the transmitter 25 and the supporter 24, and the agitator 22 is rotated. As a result, the toner stored in the storage 31 is agitated by the agitator 22.

When the driving coupling 104 is rotated as described above, the rotation is transmitted to the conveyer 23 by the transmitter 25, the supporter 24, the idle gear 93 and the connector 29, and the conveyer 23 is rotated. As a result, as shown in an arrow A in FIG. 3, the toner stored in the storage 31 is conveyed to the discharge port 33 of the storage 31 by the conveyer 23. The toner thus conveyed to the discharge port 33 of the storage 31 is discharged through the discharge port 33 of the storage 31 to the outside of the toner container 15. The toner discharged to the outside of the toner container 15 is replenished to the developing device 8 (refer to FIG. 1) through the replenishment port 107 (refer to FIG. 15) of the attachment part 16.

Next, work to check the operation of the transmitter 25 by a worker, such as a user and a serviceman, will be described.

Figure 6:
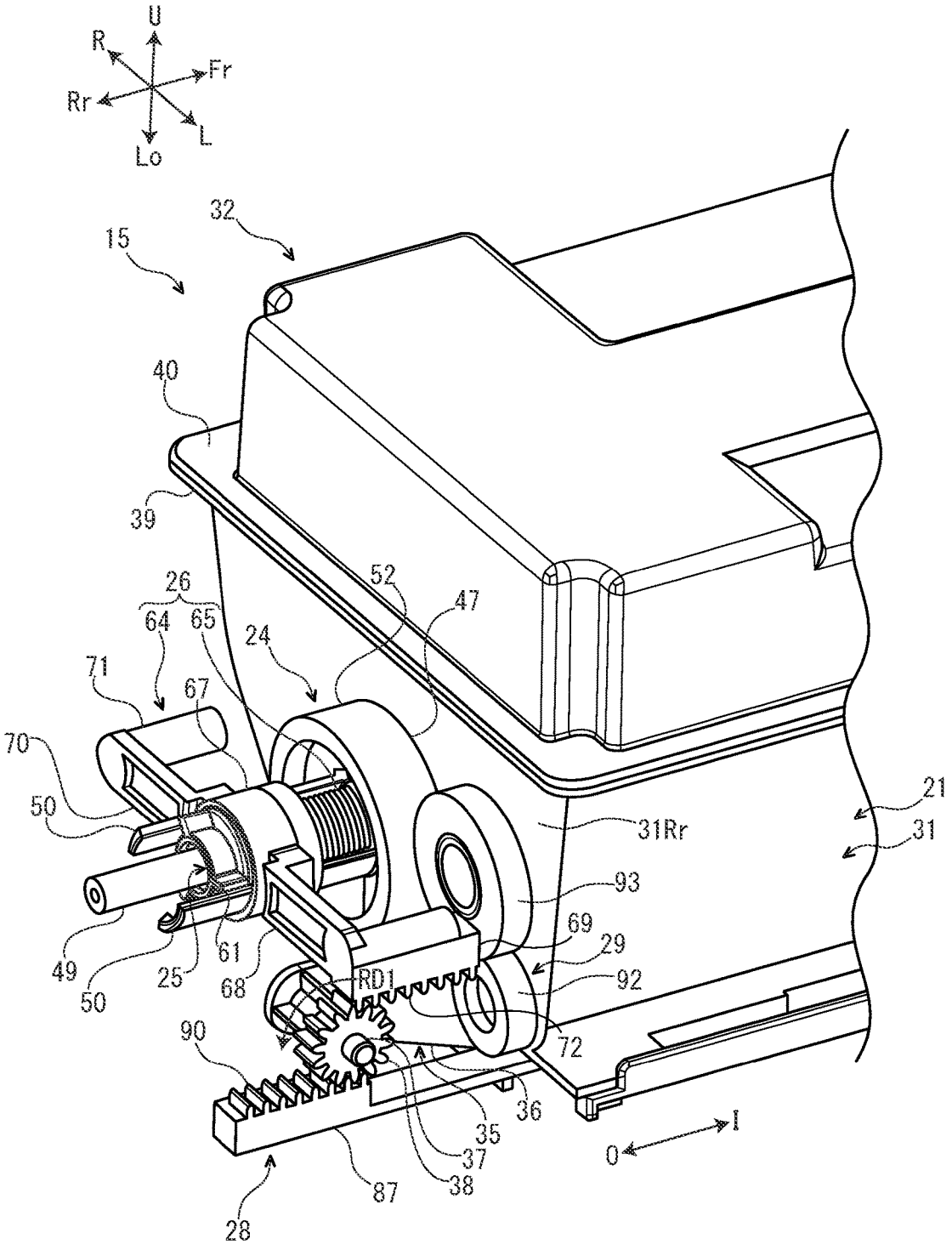
FIG. 6 is a perspective view showing a state where the transmitter is in a first position and a holder is in a first holding position, in the toner container according to the one embodiment of the present disclosure.

In a state where the toner container 15 is detached from the attachment part 16, the holder 64 is arranged in the first holding position (refer to FIG. 6 and FIG. 7). Consequently, the transmitter 25 is held in the first position (refer to FIG. 6 and FIG. 7) by the holder 64, and the transmitting coupling 61 of the transmitter 25 is retracted to an inside of the through hole 79 of the cover 27. In this state, an entire part of the transmitter 25 is retracted to an inside of the cover 27. The shutter 28 is arranged in the closing position (refer to FIG. 11).

From this state, the worker presses the shutter 28 to the front side (one side in the front-and-rear direction). Consequently, the shutter 28 is moved to the front side (the one side in the front-and-rear direction) from the closing position (refer to FIG. 11) to the opening position (refer to FIG. 12). Consequently, as shown in an arrow RD1 in FIG. 6 and FIG. 7, the pinion gear 38 meshed with the second rack gear 90 of the shutter 28 rotates in a predetermined rotation direction. Consequently, the holder 64 including the first rack gear 72 meshed with the pinion gear 38 moves to the rear side (the other side in the front-and-rear direction) from the first holding position (refer to FIG. 6 and FIG. 7) to the second holding position (refer to FIG. 8 and FIG. 9). That is, the holder 64 moves in a direction opposing to the shutter 28. Consequently, the transmitter 25 held by the holder 64 moves from the first position (refer to FIG. 6 and FIG. 7) to the second position (refer to FIG. 8 and FIG. 9). As a result, the transmitting coupling 61 of the transmitter 25 protrudes to the rear side (the outside in the front-and-rear direction) further than the through hole 79 of the cover 27.

Next, the worker releases the pressing of the shutter 28. Consequently, the shutter 28 moves to the rear side (the other side in the front-and-rear direction) from the opening position (refer to FIG. 12) to the closing position (refer to FIG. 11) by biasing force of the biasing member 99. Consequently, as shown in an arrow RD2 in FIG. 8 and FIG. 9, the pinion gear 38 meshed with the second rack gear 90 of the shutter 28 rotates in a direction opposite to the above predetermined rotation direction. Consequently, the holder 64 including the first rack gear 72 meshed with the pinion gear 38 moves to the front side (the one side in the front-and-rear direction) from the second holding position (refer to FIG. 8 and FIG. 9) to the first holding position (refer to FIG. 6 and FIG. 7). That is, the holder 64 moves in a direction opposing to the shutter 28. Consequently, the transmitter 25 held by the holder 64 moves from the second position (refer to FIG. 8 and FIG. 9) to the first position (refer to FIG. 6 and FIG. 7). As a result, the transmitting coupling 61 of the transmitter 25 is retracted to the inside of the through hole 79 of the cover 27.

As described above, the toner container 15 according to the present embodiment includes the moving mechanism 26 which moves the transmitter 25 between the first position and the second position. The moving mechanism 26 moves the transmitter 25 from the first position to the second position as the shutter 28 is moved from the closing position to the opening position, and moves the transmitter 25 from the second position to the first position as the shutter 28 is moved from the opening position to the closing position. By linking the moving of the shutter 28 with the moving of the transmitter 25, the operation to move the shutter 28 makes it possible to perform both works to check the operation of the shutter 28 and to check the operation of the transmitter 25. That is, one operation makes it possible to perform the two works. Accordingly, it becomes possible to inhibit increasing of a number of steps of the check operation of the toner container 15 and to improve workability of the check operation of the toner container 15. Additionally, with the work to check the operation of the shutter 28, it becomes possible to check the operation of the transmitter 25 easily.

As described above, when the operation of the transmitter 25 is checked, the shutter 28 moves between the opening position and the closing position. Thereby, if the operation of the transmitter 25 may be checked in a state where the discharge port 33 faces downward, the toner may be dropped through the discharge port 33 when the shutter 28 is moved to the opening position. Accordingly, when the operation of the transmitter 25 is checked, the toner container 15 is preferably reversed in the upper-and-lower direction such that the discharge port 33 faces upward.

Additionally, the moving mechanism 26 includes the holder 64 which moves along the front-and-rear direction between the first holding position where the holder 64 holds the transmitter 25 in the first position and the second holding position where the holder 64 holds the transmitter 25 in the second position, and the coil spring 65 pressing the transmitter 25 against the holder 64. By applying such a configuration, it becomes possible to move the transmitter 25 along the front-and-rear direction by the moving mechanism 26 surely.

Additionally, the toner container 15 further includes the pinion gear 38 arranged outside the case main body 21, the holder 64 includes the first rack gear 72 meshed with the pinion gear 38, and the shutter 28 includes the second rack gear 90 meshed with the pinion gear 38. In such a configuration, as the shutter 28 is moved to one side in the front-and-rear direction, the holder 64 moves to the other side in the front-and-rear direction. By applying such a configuration, it becomes possible to move the holder 64 to a direction opposing to the shutter 28. As a result, it becomes possible to protrude the holder 64 to the rear side (the outside in the front-and-rear direction) further than the through hole 79 of the cover 27.

Additionally, the first rack gear 72 is provided on the lower face of the first rack piece 69 extending from the left arm part 68 to the front side (the inside in the front-and-rear direction), and the second rack gear 90 is provided on the upper face of the second rack piece 87 extending from the shutter main body 86 to the rear side (the outside in the front-and-rear direction). By applying such a configuration, if the base part 67 of the holder 64 may be separated from the shutter main body 86 of the shutter 28, it becomes possible to mesh the rack gears 72 and 90 with the pinion gear 38 surely.

Additionally, the base part 67 of the holder 64 is inserted into the guide wall 76 of the cover 27. By applying such a configuration, the holder 64 can be supported by the cover 27 movably in the front-and-rear direction by using a simple structure.

Additionally, the transmitter 25 is supported by the supporter 24 in the state where the transmitter 25 is movable along the front-and-rear direction and is not rotatable with respect to the supporter 24, and the coil spring 65 is interposed between the supporter 24 and the transmitter 25. By applying such a configuration, it becomes possible to integrate the supporter 24, the transmitter 25 and the coil spring 65 and to arrange them in a narrow space.

Additionally, the multifunctional peripheral 1 includes the toner container 15 and the attachment part 16 to which the toner container 15 is detachably attached. By applying such a configuration, it becomes possible to replace the toner container 15 easily.

Next, operation to attach or detach the toner container 15 to or from the attachment part 16 by a worker, such as a user and a serviceman, will be described.

When the worker attaches the toner container 15 to the attachment part 16, as shown in FIG. 15, the worker inserts the toner container 15 to the attachment part 16 along the attachment direction Z. When the toner container 15 is inserted to a predetermined position in the attachment part 16, the restriction projection 106 provided in the guide plate 102 of the attachment part 16 comes into contact with the protrusion 89 of the shutter 28. This restricts the shutter 28 from being moved to the rear side (the downstream side in the attachment direction Z).

From this state, when the worker further inserts the toner container 15 to the attachment part 16 along the attachment direction Z, as shown in FIG. 16, the toner container 15 is attached to the attachment part 16. Consequently, the case main body 21 moves to the rear side (the downstream side in the attachment direction) with respect to the shutter 28 from a position where the shutter 28 is arranged in the closing position (refer to FIG. 11) to another position where the shutter 28 is arranged in the opening position (refer to FIG. 12). Consequently, as shown in the arrow RD1 in FIG. 6 and FIG. 7, the pinion gear 38 meshed with the second rack gear 90 of the shutter 28 rotates in a predetermined rotation direction. Consequently, the holder 64 including the first rack gear 72 meshed with the pinion gear 38 moves to the rear side from the first holding position (refer to FIG. 6 and FIG. 7) to the second holding position (refer to FIG. 8 and FIG. 9). Consequently, the transmitter 25 held by the holder 64 moves from the first position (refer to FIG. 6 and FIG. 7) to the second position (refer to FIG. 8 and FIG. 9). As a result, the transmitting coupling 61 of the transmitter 25 protrudes to the rear side (the outside in the front-and-rear direction) further than the through hole 79 of the cover 27, and is coupled with the driving coupling 104.

On the other hand, when the toner container 15 is detached from the attachment part 16, the worker pulls out the toner container 15 in a direction opposing to the attachment direction Z. Consequently, the coupling of the transmitting coupling 61 to the driving coupling 104 is released.

When the toner container 15 is pulled out from the attachment part 16 as described above, the case main body 21 moves to the front side (the upstream side in the attachment direction) with respect to the shutter 28 from the position where the shutter 28 is arranged in the opening position (refer to FIG. 12) to the position where the shutter 28 is arranged in the closing position (refer to FIG. 11). Consequently, as shown in the arrow RD2 in FIG. 8 and FIG. 9, the pinion gear 38 meshed with the second rack gear 90 of the shutter 28 rotates in a direction opposing to the above predetermined rotation direction. Consequently, the holder 64 including the first rack gear 72 meshed with the pinion gear 38 moves to the front side (the one side in the front-and rear direction) from the second holding position (refer to FIG. 8 and FIG. 9) to the first holding position (refer to FIG. 6 and FIG. 7). Consequently, the transmitter 25 held by the holder 64 moves from the second position (refer to FIG. 8 and FIG. 9) to the first position (refer to FIG. 6 and FIG. 7). As a result, the transmitting coupling 61 of the transmitter 25 is retracted to the inside of the through hole 79 of the cover 27.

By the way, in some cases, with the attachment operation of the toner container 15 to the attachment part 16, the driving coupling 104 is moved to be coupled to the transmitting coupling 61. However, to achieve such a configuration, the attachment part 16 requires a driving mechanism to move the driving coupling 104, and therefore, the attachment part 16 may be complicated in its structure.

However, in the present embodiment, as the moving mechanism 26 of the toner container 15 moves the transmitter 25 from the first position to the second position, the transmitting coupling 61 is coupled to the driving coupling 104. By applying such a configuration, the attachment part 16 eliminates the need for the driving mechanism to move the driving coupling 104 so that it becomes possible to suppress the complication of the structure of the attachment part 16 and to achieve space saving of the attachment part 16.

Additionally, as the toner container 15 is attached to the attachment part 16, the restriction projection 106 of the attachment part 16 comes into contact with the protrusion 89 of the shutter 28, the case main body 21 moves to the rear side (the downstream side in the attachment direction) with respect to the shutter 28 from the position where the shutter 28 is arranged in the closing position to the position where the shutter 28 is arranged in the opening position, and the moving mechanism 26 moves the transmitter 25 from the first position to the second position. By applying such a configuration, when the toner container 15 is attached to the attachment part 16, it becomes possible to open the discharge port 33 of the storage 31 automatically and to couple the transmitting coupling 61 to the driving coupling 104 automatically. Accordingly, it becomes possible to reduce a worker's load for the attachment and detachment work of the toner container 15 furthermore.

In the present embodiment, when the operation of the transmitter 25 is checked in the state where the toner container 15 is detached from the attachment part 16, the shutter 28 moves from the opening position to the closing position by the biasing force of the biasing member 99. On the other hand, in another embodiment, when the operation of the transmitter 25 is checked in the state where the toner container 15 is detached from the attachment part 16, the worker may press the shutter 28 to move the shutter 28 from the opening position to the closing position. Additionally, when the toner container 15 is detached from the attachment part 16, a part of the attachment part 16 may be engaged with the shutter 28 to restrict the moving of the shutter 28, and the case main body 21 may move with respect to the shutter 28 from the position where the shutter 28 is arranged in the opening position to the position where the shutter 28 is arranged in the closing position.

In the present embodiment, the shutter main body 86 of the shutter 28 is arranged along the outer face of the storage 31 of the case main body 21. On the other hand, in another embodiment, the shutter main body 86 of the shutter 28 may be arranged along an inner face of the storage 31 of the case main body 21.

In the present embodiment, entire parts of the agitator 22 and the conveyer 23 are stored in the case main body 21. On the other hand, in another embodiment, parts of the agitator 22 and/or the conveyer 23 may be stored in the case main body 21.

In the present embodiment, an entire part of the transmitter 25 is arranged outside the case main body 21. On the other hand, in another embodiment, a part of the transmitter 25 may be stored in the case main body 21.

In the present embodiment, the configuration of the present disclosure is applied to the multifunctional peripheral 1. On the other hand, in another embodiment, the configuration of the present disclosure may be applied to an image forming apparatus, such as a printer, a copying machine and a facsimile, other than the multifunctional peripheral 1.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A toner case comprising:

a case main body having a discharge port through which a toner is discharged;

a rotator stored in the case main body and rotating around a rotation axis;

a transmitter arranged outside the case main body and transmitting rotation to the rotator;

a moving mechanism which moves the transmitter between a first position and a second position which is arranged at an outside of the first position in a rotation axis direction of the rotator; and a shutter moving along the rotation axis direction between a closing position where the shutter closes the discharge port and an opening position where the shutter opens the discharge port, wherein as the shutter moves from the closing position to the opening position, the moving mechanism moves the transmitter from the first position to the second position, and as the shutter moves from the opening position to the closing position, the moving mechanism moves the transmitter from the second position to the first position.

2. The toner case according to claim 1, wherein the moving mechanism includes:

a holder moving along the rotation axis direction between a first holding position where the holder holds the transmitter in the first position and a second holding position where the holder holds the transmitter in the second position; and a pressing member pressing the transmitter against the holder, wherein as the shutter moves from the closing position to the opening position, the holder moves from the first holding position to the second holding position, and as the shutter moves from the opening position to the closing position, the holder moves from the second holding position to the first holding position.

3. The toner case according to claim 2, further comprising a pinion gear arranged outside the case main body, wherein the holder includes a first rack gear meshed with the pinion gear, the shutter includes a second rack gear meshed with the pinion gear, and as the shutter moves to one side in the rotation axis direction, the holder moves to another side in the rotation axis direction.

4. The toner case according to claim 3, wherein the holder includes:

a base part holding the transmitter;

an arm part extending from an outer circumferential face of the base part to an outside in a radial direction; and a first rack piece extending from the arm part to an inside in the rotation axis direction, the first rack gear is provided on a lower face of the first rack piece, the shutter includes:

a shutter main body opening and closing the discharge port; and a second rack piece extending from the shutter main body to an outside in the rotation axis direction, and the second rack gear is provided on an upper face of the second rack piece.

5. The toner case according to claim 2, further comprising a cover covering an outside of the case main body in the rotation axis direction, wherein the cover includes:

a main wall having a through hole; and a guide wall protruding from the main wall at an outer circumference of the through hole to an inside in the rotation axis direction, wherein a part of the holder is inserted into the guide wall.

6. The toner case according to claim 2, further comprising a supporter connected to the rotator, wherein the transmitter is supported by the supporter in a state where the transmitter is movable along the rotation axis direction and is not rotatable with respect to the supporter, and the pressing member is interposed between the supporter and the transmitter.

7. The toner case according to claim 1, wherein a part of the shutter is arranged along an outer face of the case main body.

8. The toner case according to claim 1, further comprising a cover covering an outside of the case main body in the rotation axis direction, wherein an entire part of the transmitter is retracted in an inside of the cover in a state where the transmitter is in the first position, and a part of the transmitter is protruded to an outside in the rotation axis direction further than the cover in a state where the transmitter is in the second position.

9. The toner case according to claim 1, wherein the transmitter moves linearly along the rotation axis direction between the first position and the second position.

10. An image forming apparatus comprising:

the toner case according to claim 1; and an attachment part to which the toner case is detachably attached.

11. The image forming apparatus according to claim 10, wherein the transmitter includes a transmitting coupling, the attachment part includes a driving coupling rotated by rotation driving force from a driving source, and as the moving mechanism moves the transmitter from the first position to the second position, the transmitting coupling is coupled to the driving coupling.

12. The image forming apparatus according to claim 10, wherein the toner case is attached to the attachment part along an attachment direction parallel to the rotation axis direction, and the attachment part includes a restriction part which comes into contact with the shutter and restricts moving of the shutter to a downstream side in the attachment direction, wherein as the toner case is attached to the attachment part, the restriction part comes into contact with the shutter, the case main body moves to the downstream side in the attachment direction with respect to the shutter from a position where the shutter is arranged at the closing position to another position where the shutter is arranged at the opening position, and the moving mechanism moves the transmitter from the first position to the second position.

* * * * *